United States Patent [19]

Day

[11] Patent Number: 4,527,358

[45] Date of Patent: Jul. 9, 1985

[54] REMOVABLE POLISHING PAD ASSEMBLY

[75] Inventor: Lawrence Day, Mount Prospect, Ill.

[73] Assignee: General Signal Corporation, Stamford, Conn.

[21] Appl. No.: 527,255

[22] Filed: Aug. 29, 1983

[51] Int. Cl.[3] ..... B24B 5/00

[52] U.S. Cl. ..... 51/131.3; 51/131.5; 51/358

[58] Field of Search ..... 51/131.3, 131.4, 131.5, 51/358, 362, 376

[56] References Cited

U.S. PATENT DOCUMENTS 3,174,258 3/1965 Kenny ..... 51/358
3,201,904 8/1965 Evans et al. ..... 51/358
3,345,785 10/1967 Riker ..... 51/362
4,020,600 5/1977 Day ..... 51/131.4

*Primary Examiner*—Frederick R. Schmidt
*Assistant Examiner*—J. T. Zatarga

[57] ABSTRACT

A removable polishing pad for a polishing machine that provides a rotatable polishing platen that supports the polishing pad. The pad assembly of this invention includes a circular polishing pad that is adhesively attached to one surface of a circular carrier disc. The polishing pad has a diameter less than that of the carrier disc such that the exposed circumferential edge of the disc is equipped to provide means for removably securing the disc to the platen for rotation therewith.

2 Claims, 4 Drawing Figures

REMOVABLE POLISHING PAD ASSEMBLY

SUMMARY OF THE INVENTION

This invention is adapted to be used in conjunction with a polishing machine of the type described in U.S. Pat. No. 4,020,600, and is also adaptable for machines of the type described in U.S. Pat. No. 4,315,383.

The basic type of polishing machine to which this present invention applies comprises a horizontal rotatable backing platen, a polishing pad extending across the upper surface of the backing platen, a load plate unit adapted to have work pieces affixed to an exposed surface thereof for positioning over the backing platen, with such work pieces engaging the polishing pad.

Conventional preparing techniques, with silicon wafers, is to polish the flat surfaces of the wafer in which devices are to be diffused. To accomplish this polishing operation the machine must be equipped with a suitable polishing pad or in the case of a double sided polishing operation dual confronting pads, that present adequate polishing surfaces to the work pieces brought into engagement therewith under pressure and rotatable movement. Substantial heat is generated during the continuous polishing operation and it in turn effects deterioration of the polishing pad necessitating frequent removal and replacement.

In the present state of the art polishing pads are adhesively affixed to the exposed surface of the rotating polishing platen. To replace a pad requires a substantial "down time" of the entire machine during which the pad is forceably removed by first saturating it with adhesive solvents and scrapping the pad from the platen, an act that completely destroys the pad.

The present invention is directed to a means for supporting a polishing pad which will permit the same to be readily removed from the rotating polishing platen of the machine. The invention consists of a carrier disc of a diameter greater than that of the polishing pad and to which is adhesively affixed the polishing pad with the disc providing means for securing itself as well as the pad to the polishing platen for rotation about a vertical axis.

Other objects of the invention will be hereinafter made apparent.

BRIEF DESCRIPTION OF THE DRAWINGS

The invention will be best understood by reference to the accompanying drawings which illustrate the preferred mode of construction by which the stated objects of the invention are achieved, and in which.

GENERAL DESCRIPTION

Figure 3:
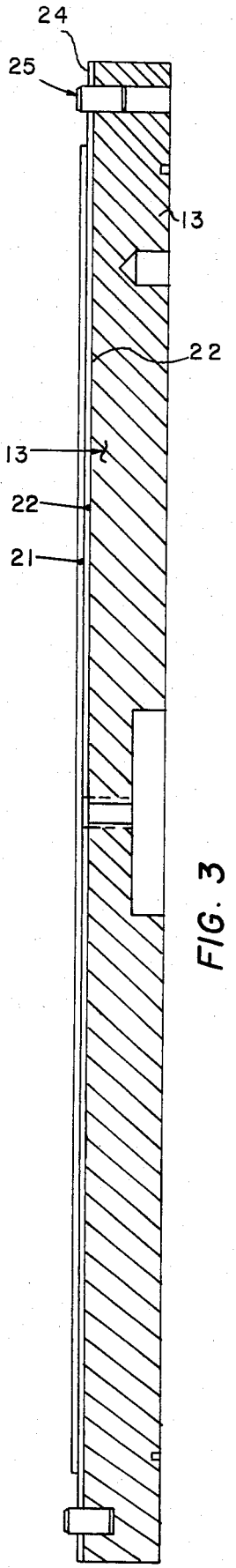
FIG. 3 is a detailed sectional side elevational view of the composite invention.
Figure 1:
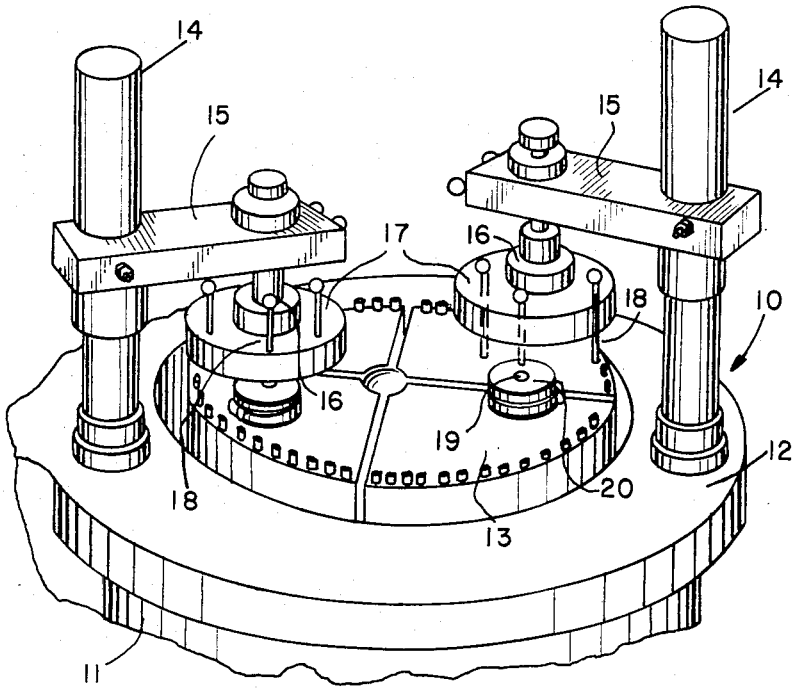
FIG. 1 is a fragmentary perspective view of one type of polishing machine that will accommodate the invention.

Referring to FIG. 1, there is indicated generally a polishing machine 10, which includes a base portion 11 supporting a horizontal apron 12. This apron 12 surrounds a rotatable polishing platen 13. Carried by and extending vertically from the apron 12 are shown a pair of vertical columns 14, each in turn supporting a lateral arm 15. The construction and operation of the vertical columns 14 and the respective lateral arms 15 are of a type well known in the art and make up no part of the present invention except for the environment thereof.

As shown in FIG. 1, each of the lateral arms 15 provide a depending spindle which, through a swivel coupling 16, supports a circular pressure plate 17. The pressure plate 17 is thus movably connected to the lateral arm 15 and the vertical column 14, so that movement vertically thereof and laterally thereof can be achieved as described.

The circular pressure plate 17 is provided with a plurality of openings which receive a like number of depending pins 18. The free ends of the pins 18 are adapted to sit within a central recess 19 formed in the top surface of a work piece chuck 20.

Figure 2:
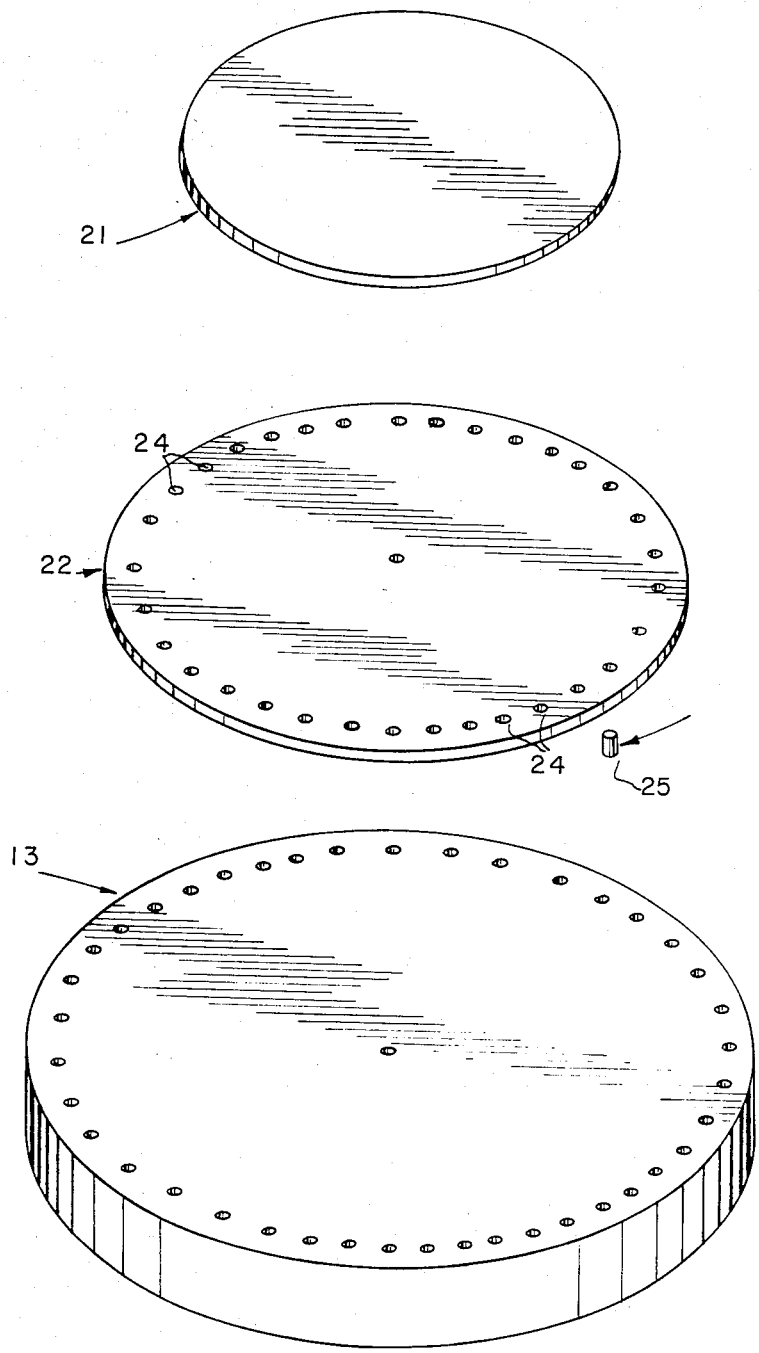
FIG. 2 is a perspective view of the components of the invention in an exploded relationship.

As viewed in FIG. 2, there is illustrated in exploded relationship the composition of the polishing pad of this invention. As such there is provided a circular polishing pad 21 having a thickness in the range of 0.15/0.06 mm/inch, that is usually manufactured from a polyurethan composition. This pad 21 is adhesively attached to a carrier disc 22 preferably manufactured from a polycarbonated composition. It should be noted that the disc 22 has a diameter greater than that of the pad 21 and thus provides an exposed circumferentially extending peripheral edge 23.

Adjacent to the peripheral edge 23 of the disc 22 in its exposed edge area, is a series of apertures 24 circumferentially arranged and equally spaced from each other. These apertures 24 will receive holding pins 25 a portion of which extends vertically from the platen 13 in a corresponding equally spaced circumferential arrangement.

By this arrangement the disc 22 with the polishing pad 21 secured thereon may be releasably attached to the rotatable platen 13 for rotatable movement through a horizontal plane beneath the pressure plates 17.

In order to prevent facial displacement of the disc 22 from the face of the platen 13 it has been found that by wetting the polishing platen 13 with a liquid solution, such as ethylene glycol, that there will develop therein a capillary action that will prevent facial distortment between the parts during their operation horizontal rotational movement.

From the foregoing it is apparent that there is provided a polishing pad 21 which is fixedly secured to a removable carrier disc 22 which is secured onto a polishing platen 13 by cooperating means that will prevent horizontal displacement during the operational rotation of the parts. There is also provided a method which will prevent facial distortment or displacement between confronting surfaces of the disc 22 and the platen 13 during the operational movement of the polishing pad.

As the wafer polishing operation proceeds and there is a requirement for replacement of the polishing pad, the carrier disc can be conveniently dislodged from the holding pins 25 effecting removal and replacement of the polishing pad 21. This arrangement avoids extended down time of the polishing machine while permitting the satisfactory polishing operation thereof. This arrangement permits a ready replacement of a like or different polishing pad on the machine as the operation requires.

Figure 4:
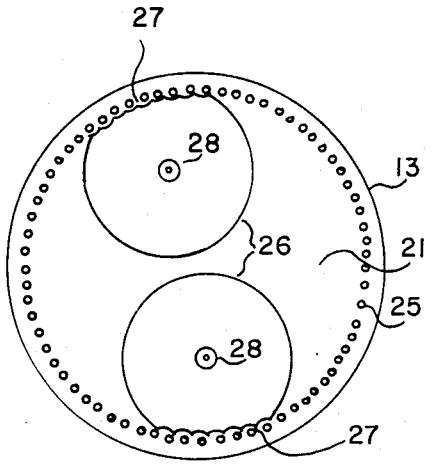
FIG. 4 is a top plan view of a modified polishing machine embodying this invention.

Referring to FIG. 4, there is illustrated a structural arrangement by which a desirable planetary rotational movement may be achieved upon the work pieces to be polished. The modified work piece chuck holders 26 are formed so as to provide peripheral tooth-like gear members 27 which are adapted to have engagement with the pins 18 carried by the platen 13. By this arrangement, as the platen 13 rotates and rotates the polishing pad 21, the work piece holders 26 will also be caused to rotate about their spindle connection 28 provided by a suitable coupling (not shown) to the support arm 15. Thus, when the platen 13 is rotated the engagement of the pins 18 with the gear-like teeth 27 will rotate the holder 26 about a vertical axis and it in turn will rotate the work pieces across the exposed face of the polishing pad 21.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention, what I claim as new and desire to secure by Letters Patent is:

1. A polishing pad assembly for a work piece polishing machine, comprising;

(a) a polishing platen rotatable about a vertical axis through a horizontal plane, (b) a polishing pad carrier disc removably mounted upon one exposed surface of said platen, (c) a polishing pad releasably attached to one surface of said carrier disc and providing an exposed polishing face for engagement with a work piece to be polished, (d) a set of work piece holder plates freely positioned in facial abutment upon said exposed polishing face of said polishing pad, (e) a series of holding pins extending perpendicularly from said one exposed surface of said platen in a circular pattern about the periphery thereof, and a series of openings formed in a like circular pattern in said polishing pad carrier disc and into which said pins project for releasably mounting said polishing pad carrier disc onto said one exposed surface of said platen for rotation therewith through a horizontal plane, and (f) a series of gear like teeth formed on the periphery of each of said work piece holder plates for engaging said holding pins as they project through said openings formed in said polishing pad carrier disc, rotating said work piece holder plate about their vertical axis as said platen rotates about its axis through a horizontal plane.

2. A polishing pad assembly as defined by claim 1, including means between the confronting surfaces of said polishing pad carrier disc and said one exposed surface of said platen restricting facial separation therebetween during rotation through a horizontal plane.

* * * * *